United States Patent [19]

Uhtenwoldt

[11] 4,363,195

[45] Dec. 14, 1982

[54] INTERNAL GRINDING MACHINE WITH WEDGE FEED MECHANISM

[75] Inventor: Herbert R. Uhtenwoldt, West Boylston, Mass.

[73] Assignee: Cincinnati Milacron - Heald Corp., Worcester, Mass.

[21] Appl. No.: 216,322

[22] Filed: Dec. 15, 1980

[51] Int. Cl.[3] ..... B24B 49/00

[52] U.S. Cl. ..... 51/165.77; 51/165.92; 51/165.93

[58] Field of Search ..... 51/165.77, 165.8, 165.87, 51/165.93

[56] References Cited

U.S. PATENT DOCUMENTS

| | | | |
|---|---|---|---|
| 3,222,823 | 12/1965 | Seidel | 51/165.87 |
| 4,074,467 | 2/1978 | Robillard | 51/165.93 |
| 4,096,667 | 6/1978 | Uhtenwoldt | 51/165.93 |

*Primary Examiner*—Harold D. Whitehead

*Attorney, Agent, or Firm*—Thomas M. Farrell

[57] ABSTRACT

A grinding machine has a base and a pair of work support bars journalled within the base. A table is journalled with the support bars in such fashion that it is axially movable along the parallel spaced bars and pivotable around one bar central axis while the other bar is radially displaced relative to the base. A pair of ramp surfaces having ramp planes disposed transversely to the pivot axis of the table are provided on the radially movable bar, such that a wedge feed is accomplished by relatively moving a powered wedging device along the ramp plane to thus radially move the movable bar, thereby causing table feed movement with respect to the base. A work support head stock is preferably carried on the base, and a wheelhead having a rotable grinding wheel is carried on the table, so that pivotal movement of the table causes relative feed movement of the grinding wheel with respect to a supported workpiece.

3 Claims, 8 Drawing Figures

INTERNAL GRINDING MACHINE WITH WEDGE FEED MECHANISM

BACKGROUND OF THE INVENTION

In the field of grinding machines, in particular internal grinding machines for grinding workpieces of revolution, it is necessary to incorporate in the machine tool a slide movement for axially moving the grinding wheel into the bore area and thereafter, providing a radial feed movement to the grinding wheel to accomplish the grinding operation on the workpiece. Many types of compound slide systems have been developed in the prior art and are useful for providing the coordinate movement necessary during the grinding cycle, but several recently patented mechanisms have been developed for grinding machines, which greatly minimize the dependency on flat way slides for an internal grinding machine. The grinding machine shown in U.S. Pat. No. 4,096,667 (1978) illustrates a mechanism wherein a pair of parallel spaced bars are employed to provide the axial slide movement along the bar axis for presenting the grinding wheel into the bore of a workpiece. Subsequently, the radial feed movement is provided by pivoting the grinding wheel mount about the journal axis of a first bar, by radially displacing the second support bar from its normal position, thus tilting the grinding wheel support table and causing radial feed movement of the grinding wheel with respect to the workpiece. The radial displacement of the secondary support bar is accomplished by an elevating screw and nut assembly which is powered by a prime mover stepping motor, wherein all modes of feed are accomplished by the screw system. To accomplish very fine movement of the screw and nut combination, and thus proportional movement of the grinding wheel with respect to the workpiece, very large reduction mechanisms must be employed, such as worm and worm wheel drives off the prime mover to the feed screw. Further, the rigidity of the feed mechanism is solely dependent on the elevating screw and respective support bearings.

Applicant has obviated several infirmities in the foregoing design by providing a feed mechanism capable of very fine resolution output from a relatively coarsely controlled input motion. Further, applicant has provided a relatively stiff support for a secondary bar of such a twin bar support system.

SUMMARY OF THE INVENTION

The invention is shown embodied in a grinding machine capable of grinding internal bores of a workpiece of revolution, wherein the grinding machine is comprised of a base having base journal means with a first pivot axis and wherein the journal means comprises a pair of support bars parallelly disposed with respect to one another so that a wheelhead support table may be longitudinally moved along the axis of the support bars in a first motion, and thereafter, the wheelhead support table may be pivotally tilted about the first or primary bar by radial displacement of the secondary bar. A work support is carried on the base in the preferable mode, and a wheelhead is carried by the wheelhead support table. Radial displacement of the secondary support bar is accomplished by the ramp feed means including at least one ramp element having its ramp plane transversely disposed to the pivot axis so that as a ramp wedge feed element is moved generally in the direction of the longitudinal axis of the bar, the bar will thereby be radially displaced relative to the base, effecting pivoting of the wheelhead table about the pivot axis, thus causing feed of the wheelhead relative to the work support.

DESCRIPTION OF THE PREFERRED EMBODIMENT

Figure 1:
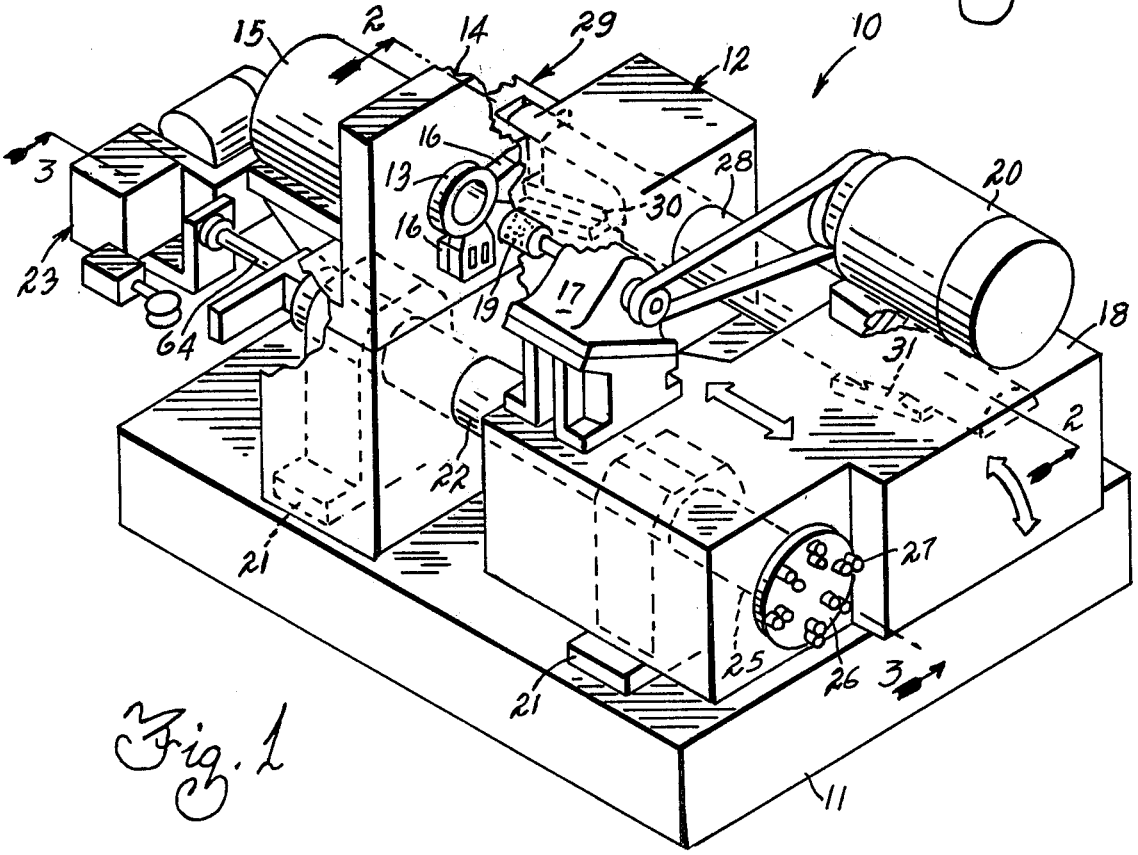
FIG. 1 is a perspective view of the grinding machine of the present invention.

Referring now to the drawings, and particularly FIG. 1 thereof, there is shown a grinding machine 10 of the internal grinding type, having a base 11 upon which is supported a work support 12 for supporting and driving a workpiece 13 of revolution. The work support 12 is shown as a headstock 14 having a conventional motor means 15 for driving the workpiece 13 on a pair of work support shoes 16 for accurate location during the grinding process.

A grinding wheelhead 17 is carried on a wheelhead support table 18. The table 18 is adapted for both linear and pivotal movement in the direction of the arrows. The grinding wheel 19 is provided with a suitable drive 20 for imparting rotary motion to the grinding wheel 19 to effect a grind operation. Here it should be noted that movement between the grinding wheel 19 and workpiece 13 is relative and, as such, the grinding wheel 19 could be fixed on the base 11, while the workpiece 13 would then be movable with the table 18. The base 11 carries a pair of journal blocks 21, in which a first support bar 22 is adapted for both rotary and linear movement. Linear movement of the bar 22 is provided by a conventional feed means 23 including a piston-powered rod 64 and is well-known in the art. The table 18 is secured to an end 25 of the first support bar 22 by an adapter plate 26 which is secured to both the bar 22 and the table 18 by screws 27.

Figure 2:
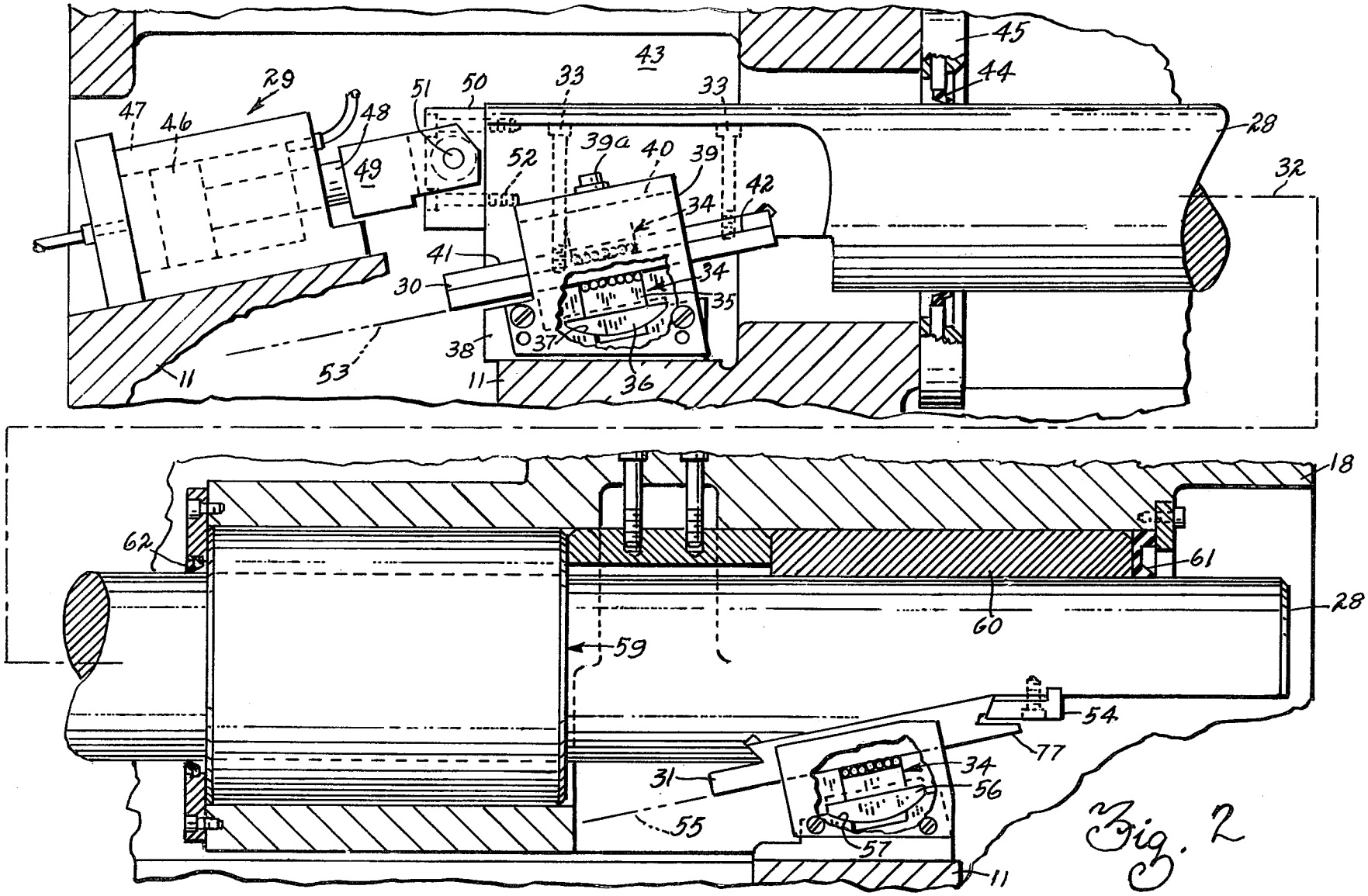
FIG. 2 is an elevational section taken along the cutting plane 2—2 of FIG. 1.

A second support bar 28 is spaced apart from the first support bar 22 and is carried on the base 11 by a ramp feed means 29 (which will be detailed further in FIG. 2). The table 18 is journalled on the second support bar 28 such that it can move linearly relative to the bar 28 and further that it will be radially displaced along with the bar 28 as the bar 28 is displaced by the ramp feed means 29. As the secondary bar 28 is radially displaced, it can be seen that pivotal movement of the table 18 about the first journalled support bar 22 will occur, thus causing a radial feed movement of the grinding wheel 19 with respect to the workpiece 13.

The section shown in FIG. 2, clearly illustrates that the secondary bar 28 is supported on a pair of ramp plates 30,31 parallel to one another and angled to the longitudinal bar axis 32. The left hand end of the bar 28 has a ramp plate 30 secured thereto by screws 33 passing through the bar 28, and the plate 30 is in turn supported on a bearing 34, herein preferred to be an antifriction roller bearing of the recirculating type, such as a Tychoway bearing. The lower bearing block 35 is supported on a rocking shoe 36 which is a generally circular sector nested in a cooperating socket 37 of a base 38 which is secured to the machine base 11. The base member 38 has a pair of side plates 39 secured thereto, which extend upward along the side of the ramp plate, and extend for a portion 40 across the top 41 of the ramp plate 30. The angled portion 40 has a second recirculating roller bearing 34 secured thereto by screw 39*a*. The bearing 34 contacts a secondary ramp surface 42 on the ramp plate 30 so that the plate 30 is entrapped by the base-carried roller bearings 34. In this fashion, therefore, it may be seen that positive control of the ramp plate 30 in its excursion may be accomplished so that the ramp plate 30 and consequently the second support bar 28 is thereby forced up and down in the vertical direction as the ramp plate 30 is powered linearly across the recirculating roller bearings 34. The left end of the second support bar 28 extends into an enclosed cavity 43 of the machine base 11 through a compliant slidable seal 44, which is effective to prevent contaminants from entering the cavity 43. The slidable seal 44 is radially movable and is carried by a seal cap 45 which is secured to the base 11. In this manner, the seal 44 may be radially displaced as the bar 28 is displaced. A prime mover ramp feed means 29 or feed mechanism is shown mounted to the machine base 11. The feed mechanism herein depicted is a piston cylinder arrangement in which a feed piston 46 is powered by hydraulic fluid relative to a cylinder 47 secured to the base 11. An outer end of the piston rod 48 is mounted by a clevis bracket 49 to a clevis block 50 by a pin 51. The clevis block 50 is mounted by screws 52 to the end of the second support bar 28. While the linear prime mover means 29 could be mounted in a variety of attitudes relative to the bar 28, it is shown parallel to the ramp plane 53 of the ramp plate 30, so that the primary thrust is directed along the ramp plane 53. It can be seen therefore that as the prime mover means 29 is actuated, the ramp plate 30 will be caused to elevate or descend through the bearings 34, thus causing simultaneous linear movement of the support bar 28 in the direction of the longitudinal axis 32, and radial displacement of the bar as well. The right hand end of the second support bar 28 as shown in FIG. 2, illustrates that the second ramp plate 31 is locked to the support bar 28 by a dovetail mounting arrangement and a dovetail clamp 54. The ramp plate 31 has only a primary surface 77, forming a second ramp plane 55, which is supported on a pair of side-by-side recirculating support bearings 34 which, in turn, are carried on a rockable self-aligning support shoe 56 and cooperating seat 57 in a bearing support member 58 which is secured to the base. By this arrangement, the distal end of the second support bar 28 (relative to the feed means 29) is supported from deflection. The wheelhand table 18 is supported on the secondary bar 28 for relative rotary and linear movement by means of a first bearing 59 which completely encircles the support bar 28 and a half bearing 60 which is provided to support and balance the downward weight of the table 18 on the bar 28. Suitable seals 61,62 are provided at each end of the table 18 to wipe contaminants from the bar 28 and protect the bearings 59,60.

Figure 3:
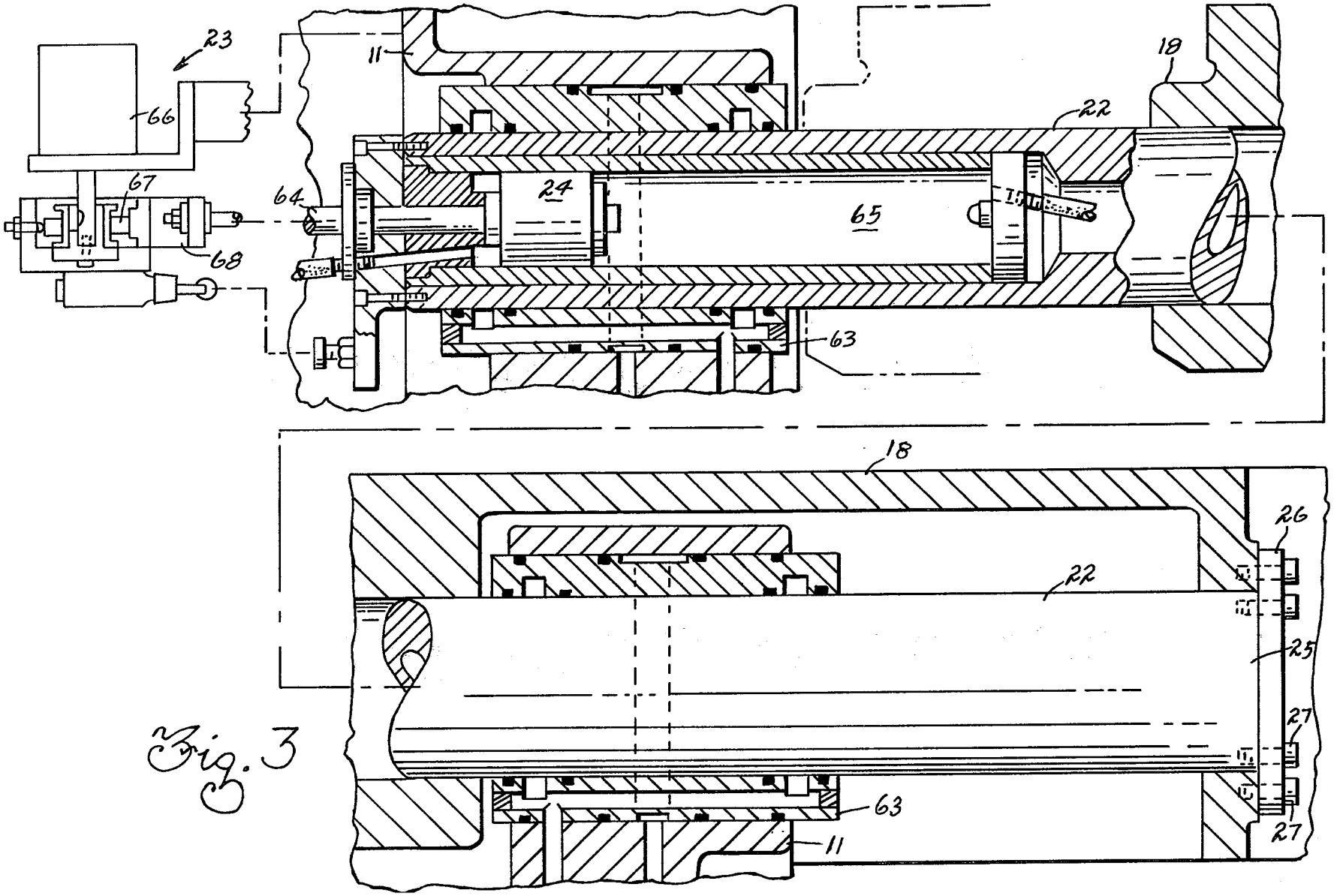
FIG. 3 is an elevational section taken along the cutting plane 3—3 of FIG. 1.

The section shown in FIG. 3 is provided to illustrate the mounting arrangement of the primary support bar 22 which is carried in the journal bearings 63 of the base 11, and is adapted to both rotate and linearly move with the respect to the journal bearings 63 as the table 18 is moved in response to feed of the second support bar 28. The right hand end of the table 18 is shown tied to the first support bar 22 by an adapter plate 26 secured to the two 18,22 by screws 27. The left hand end of the first support bar 22 is shown affixed to a piston 24 extending from the bar feed means 23 by a piston rod 64, and the piston 24 is shown within a cylinder 65 defined in the left end of the first support bar 22 so that hydraulic fluid may be introduced into the cylinder and the cylinder will be linearly moved with respect to the piston 24. The piston 24 may further be oscillated by a rotary drive motor 66 through a cam 67 and shiftable cam follower 68 connected to the piston rod 64. The bar feed means 23 depicted at the left end of the first support bar 22 for linearly moving and oscillating the bar 22 is conventional and is shown in U.S. Pat. No. 4,006,667. However, it may be appreciated that other linear motion mechanisms may be employed to drive the first support bar 22, such as a screw and nut mechanism; rack and pinion; and the like.

Figure 5:
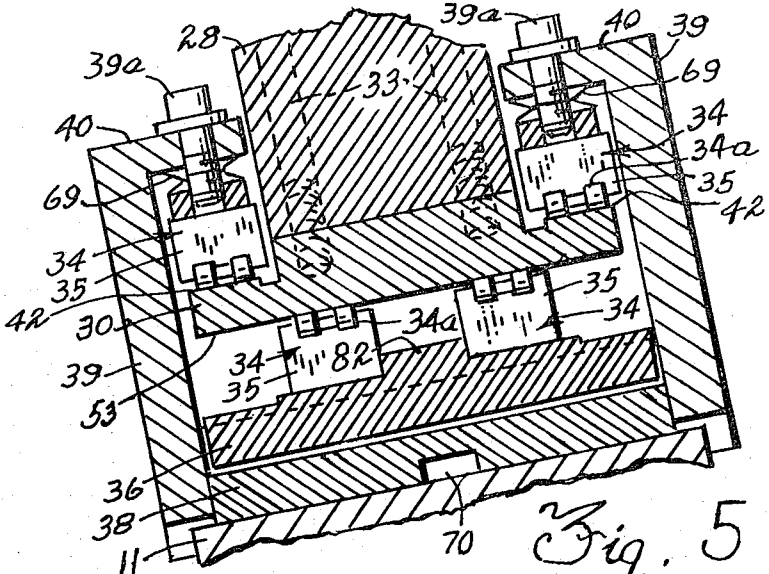
FIG. 5 is a section taken along the line 5—5 of FIG. 4.
Figure 4:
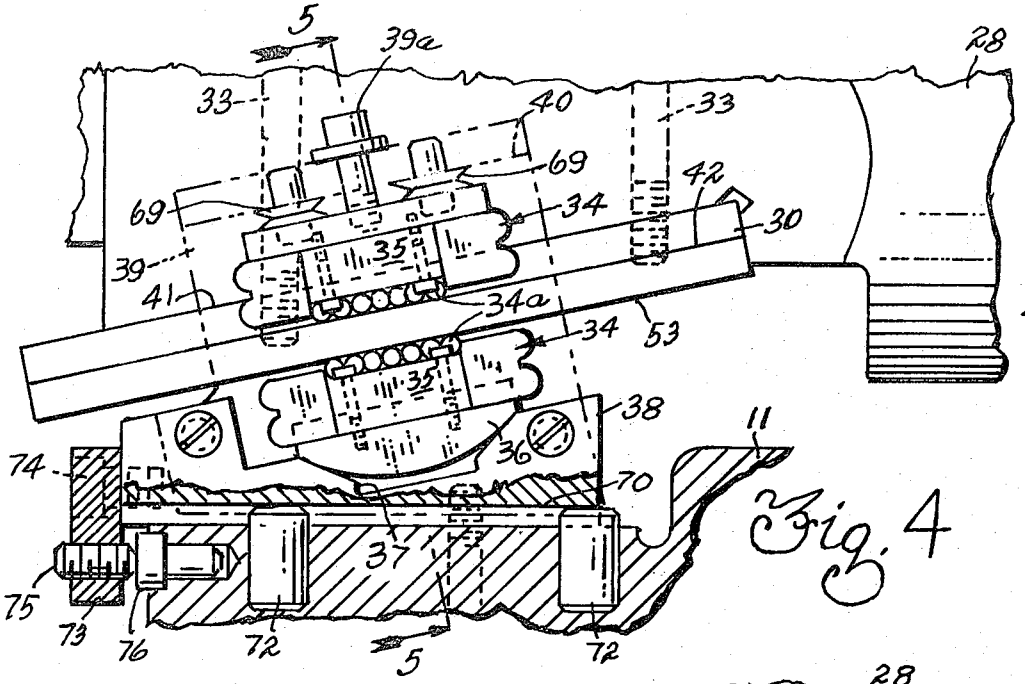
FIG. 4 is an elevational section showing an enlarged view of the left hand end of FIG. 2.

FIG. 4 is an enlarged view showing the left end of the second support bar 28 with its companion primary ramp plate 30. Here the ramp plate plane 53 and second surface 42 are shown entrapped between the circulating roller elements 34*a* of the roller bearings 34, and the upper roller bearing 34 is shown preloaded through means of belleville spring washers 69 to provide a positive movement of the bar 28 in response to the ramp feed means 29 (not shown). The bearing base member 38 is provided with a central key slot 70 which is closely fitted about a pair of locating pins 72 carried in the base 11 and an adjusting block 73 is carried at the end of the bearing base member 38 by screws 74, wherein an adjusting screw 75 may be closely positioned against a rest button 76 in the base 11, for accurate positioning of the roller bearings 34 relative to the ramp plate 30, for precisely locating the radial position of the secondary support bar 28. The section of FIG. 5 further illustrates the straddle mounting arrangement of the upper and lower roller bearings 34 on the ramp planes and secondary surface 42 of the ramp plate 30. Further shown is the upper angled portion 40 of the side plates 39, which provide backup for the preloaded belleville spring washers 69.

Figure 7:
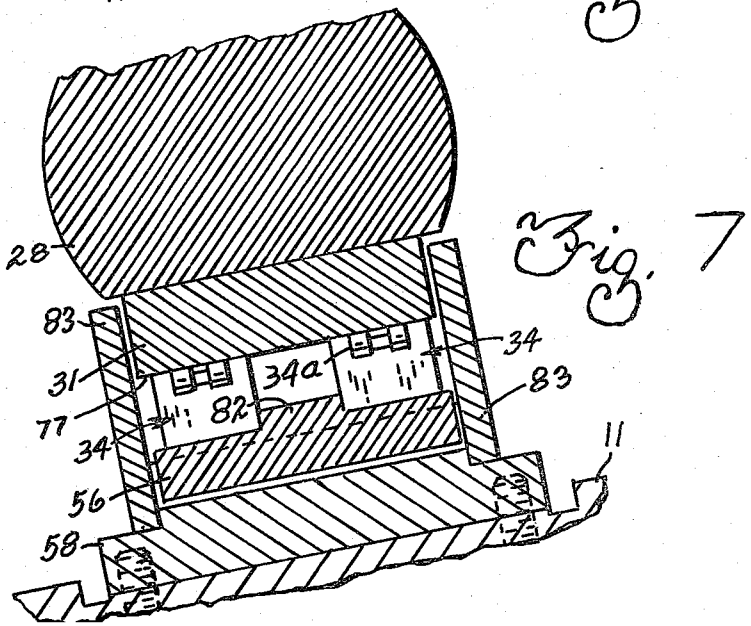
FIG. 7 is a section taken along the line 7—7 of FIG. 6.
Figure 6:
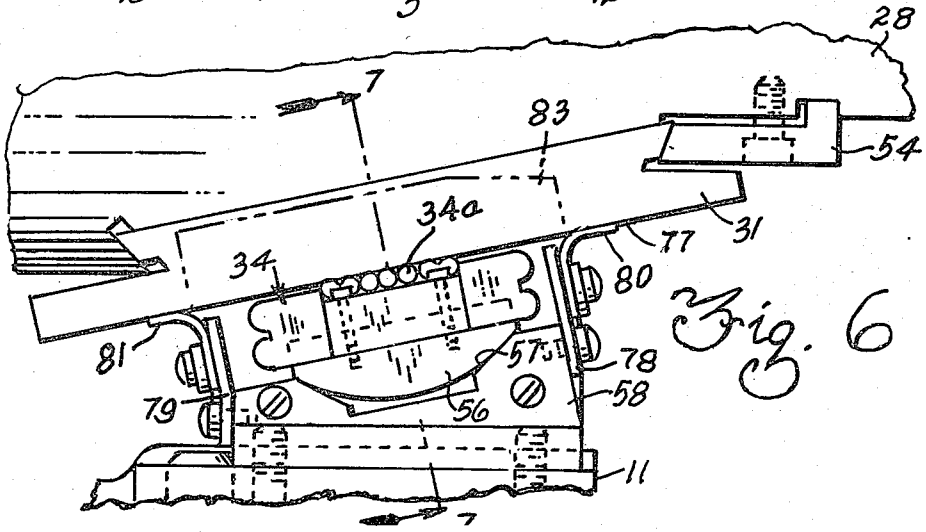
FIG. 6 is an enlarged view of the right hand end of FIG. 2.

FIG. 6 depicts an enlarged view of the outboard end of the secondary support bar 28 with its second ramp plate 31 secured in a dovetail mounting arrangement and held by a dovetail clamp 54. The roller bearing 34 is shown in contact with the primary ramp surface 77 and the bearing 34 is supported in the self-aligning shoes 56. A pair of wiper plates 78,79 with respective elastomeric wiper sheets 80,81 are carried at each end of the roller base member 58 and serve to wipe contaminants from the primary ramp surface 77 so that metal-to-metal contact is maintained between the ramp plate 31 and the recirculating rollers 34*a*. The section of FIG. 7 further illustrates that a pair of recirculating roller bearings 34 are carried on the self-aligning shoe 56 which has a spacer portion 82 at its center to spread the roller bearings 34. A pair of side plates 83 are secured to the base member 58 and serve to limit travel of the ramp plate 31 and secondary bar 28 in a sideways direction, and the plates 83 further serve to generally keep contaminants from finding their way into the bearing-engaging plane 77.

Figure 8:
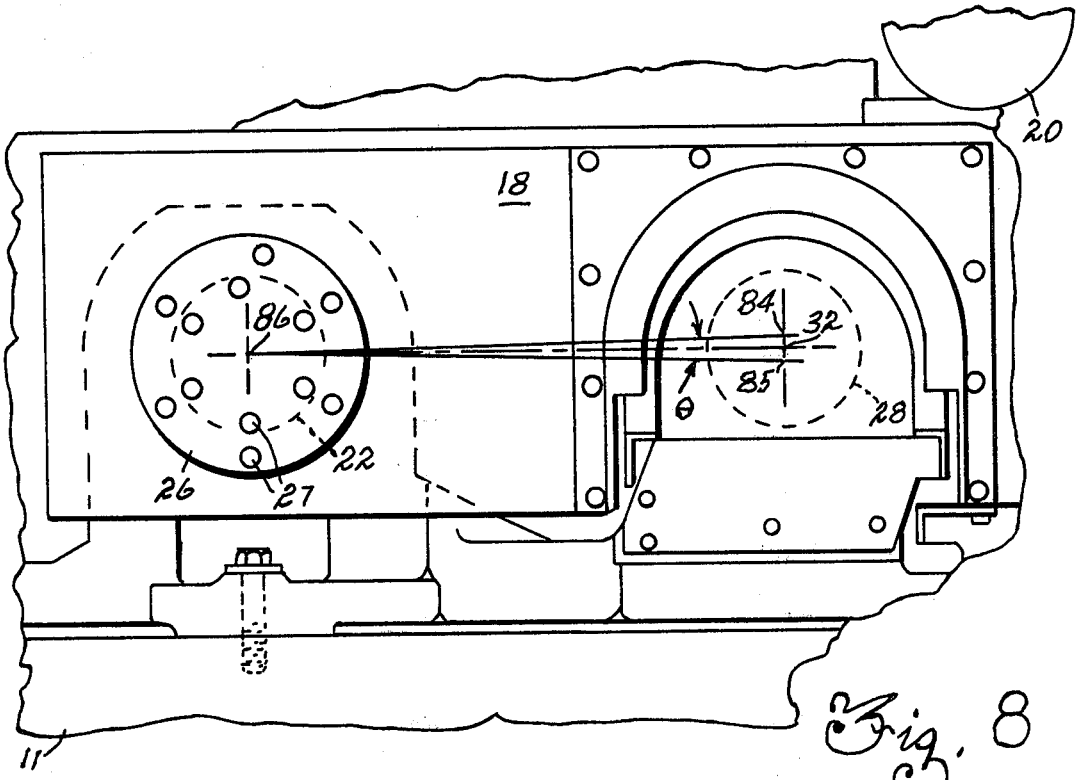
FIG. 8 is an end view of the grinding machine of FIG. 1.

The end view shown in FIG. 8 depicts the wheelhand support table 18 as it is carried by the machine base 11, and the end plate 26 is shown secured to the primary support bar 22 and the wheelhand table 18 by a plurality of screws 27. The second support bar 28 is shown with its axis 32 positionable between uppermost and lowermost points 84,85 as it is moved radially under the influence of the ramp feed means 29 (see FIG. 2) thereby causing the wheelhand table 18 to pivot through the angle $\theta$ about the central axis 86 of the primary support bar 22. Here it may be noted that while the axis 32 of the secondary support bar 28 is moved in a vertical radial direction, the axis 32 of the bar 28 will also undergo a very slight horizontal movement which is the equivalent of the chordal height of the arc traversed by the center distance between the spaced-apart bars 22,28 when moved through the angle $\theta$.

It is not intended that the invention herein be limited to the specific embodiment shown, but rather the invention comprises all such designs and modifications as come within the scope of the appended claims.

What is claimed is:

1. A grinding machine, comprising:

(a) a base;

(b) base journal means including an elongate first support bar and longitudinal first support axis together with a substantially parallel spaced-apart elongate second support bar and longitudinal second support axis;

(c) a table journalled with said base journal means for relative movement along said axes;

(d) a work support carried by one of said base and table;

(e) a wheelhead carried by the other of said base and table; and (f) ramp feed means, moveable generally along said second support axis, including at least one ramp surface canted to said second support bar to form an oblique angle with said second support axis and affixed to one of said second support bar and base, and further including a ramp surface reaction member affixed to the other of said second support bar and base, wherein relative movement of said surface and said reaction member generally along said second support axis and parallel to said first support axis causes said second support bar to undergo radial translatory movement relative to said base, thereby effecting pivotal movement of said table about said first support axis.

2. A grinding machine according to claim 1, further comprising means to linearly move said table relative to said base in a direction substantially parallel to said pivot axis.

3. A grinding machine, according to claim 2 wherein said base journal means comprises in part a bearing relatively fixed to said base, and a support bar, cooperating with said bearing for relative linear and rotary motion, and further wherein said table is relatively fixed to said support bar.

* * * * *